US005373832A

United States Patent [19]

D'Andrade

[11] Patent Number: 5,373,832

[45] Date of Patent: Dec. 20, 1994

[54] MULTI-SHOT SOFT PROJECTILE PRESSURIZED TOY GUN

[76] Inventor: Bruce M. D'Andrade, 3 Ten Eyck Rd., Whitehouse Station, N.J. 08889

[21] Appl. No.: 89,835

[22] Filed: Jul. 12, 1993

[51] Int. Cl.[5] ..... F41B 11/26

[52] U.S. Cl. ..... 124/69; 124/59; 124/73

[58] Field of Search ..... 124/56, 59, 69–74, 124/76, 66

[56] References Cited

U.S. PATENT DOCUMENTS

| | | | |
|---|---|---|---|
| 1,026,303 | 5/1912 | Dickey | 124/69 |
| 1,214,398 | 1/1917 | Welch | 124/69 |
| 1,309,321 | 7/1919 | Fairweather | 124/69 |
| 1,404,689 | 1/1922 | Fairweather | 124/69 |
| 1,488,995 | 4/1924 | McCollom . | |
| 1,575,644 | 3/1926 | Schmidt . | |
| 1,818,810 | 8/1931 | Miller | 124/69 |
| 2,011,749 | 8/1935 | Brading . | |
| 2,237,678 | 4/1941 | Lohr et al. . | |
| 2,733,699 | 2/1958 | Krinsky | 124/69 |
| 2,784,712 | 3/1957 | Cassidy | 124/69 |
| 2,818,056 | 12/1957 | Martin . | |
| 4,159,705 | 7/1979 | Jacoby | 124/70 X |
| 4,223,472 | 9/1980 | Ferete et al. | 124/70 X |
| 4,732,136 | 3/1988 | Ferri . | |
| 4,735,239 | 4/1988 | Salmon et al. . | |
| 4,848,307 | 7/1989 | Tsao | 124/59 |
| 4,854,480 | 8/1989 | Shindo . | |
| 4,892,081 | 1/1990 | Moormann . | |
| 5,242,323 | 9/1993 | Rappaport | 124/66 X |

*Primary Examiner*—Randolph A. Reese
*Assistant Examiner*—John A. Ricci
*Attorney, Agent, or Firm*—Kenneth P. Glynn

[57] ABSTRACT

The present invention is a multiple projectile-shooting air gun. It includes a main housing having a barrel adapted for receiving a projectile, a handle and a trigger, as well as a high pressure, inflatable bladder connected to the main housing, the bladder having an inlet and an outlet. There is also a pressurizing mechanism for providing air pressure to the bladder to inflate it. The pressurizing mechanism is physically connected to the housing and functionally connected to the bladder inlet. There is a bladder deflation valve having an upstream side and a downstream side, and it is connected to the bladder outlet at the valve's upstream side, and is connected to the trigger for opening and closing thereof, and is connected to a projectile launch port at the valve's downstream side for launching a projectile upon deflation of at least a portion of the bladder when it has been inflated. The launch port is located in the barrel of the main housing and connected to the downstream side of the bladder deflation valve, and is functionally connected to a launch tube adapted for receiving and shooting a projectile. The launch tube is one of a plurality of launch tubes which are located on a rotating magazine. The magazine advances after each shot to position the next launch tube with projectile for firing.

11 Claims, 3 Drawing Sheets

MULTI-SHOT SOFT PROJECTILE PRESSURIZED TOY GUN

BACKGROUND OF THE INVENTION

1. Field of the Invention

The present invention is directed to air pressurized toy guns for launching projectiles. More specifically, the toy air gun of the present invention relies upon a pressurizable bladder for release of air pressure to shoot the projectile, e.g. a soft dart, and has multiple shot capabilities.

2. Information Disclosure Statement

Air guns have been available for decades and typically rely upon a reciprocal hand pump to compress air in a chamber for subsequent firing. These are often used for firing BB's or pellets. Other gas powered guns rely upon canisters of compressed gas wherein the gas is released for firing. Toy guns which involve the use of bladders have been developed for storing and shooting water.

The following patents are representative of toy guns, illustrating in chronological order toy guns which shoot projectiles or utilize bladders:

U.S. Pat. No. 1,488,995 issued to Edwin McCollom describes a projectile shooting toy gun which relies upon a spring loaded, u-shaped rod which is cocked by pulling and released by a trigger release.

U.S. Pat. No. 2,011,749 to Harry Brading describes a dart game which uses a blow pipe for launching the darts.

U.S. Pat. No. 1,575,644 to William Schmidt describes a pistol which fires a projectile and relies upon a compression spring to compress air and to thereby actuate the firing of the projectile.

U.S. Pat. No. 2,237,678 issued to Raymond Lohr et al describes a repeating, cork shooting toy which utilizes a cork magazine which rotates after each firing to position the next cork in sequence for firing.

U.S. Pat. No. 2,818,056 to Robert Martin describes a compressed gas-operated propelling mechanism in a toy gun.

U.S. Pat. No. 4,732,136 issued to Giampiero Ferri sets forth a toy gun which relies upon spring based compression to a launch a plastic bullet or the like.

U.S. Pat. No. 4,735,239 issued to Michael Salmon et al describes a liquid projecting device which is basically a bladder and a release trigger, the bladder being expanded by being filled up with water. Likewise, U.S. Pat. No. 4,854,480 issued to Robert Shindo describes a water gun with an expandable rubber tube or bladder which is filled with water and subsequently released by the trigger mechanism.

U.S. Pat. No. 4,892,081 Randall Morrmann sets forth a compressible ball launcher which relies upon a telescoping cylindrical gun to compress air to force a ball out of a nozzle.

Notwithstanding the foregoing, the prior art neither teaches nor suggests the use of a pressurized bladder, pumped up by a pump on a toy gun, to release pressure for shooting a plurality of projectiles sequentially, as in the present invention.

SUMMARY OF THE INVENTION

The present invention is a multiple projectile-shooting air gun. It includes a main housing having a barrel adapted for receiving a projectile, a handle and a trigger, as well as a high pressure, inflatable bladder connected to the main housing, the bladder having an inlet and an outlet. There is also a pressurizing mechanism for providing air pressure to the bladder to inflate it. The pressurizing mechanism is physically connected to the housing and functionally connected to the bladder inlet.

There is a bladder deflation valve having an upstream side and a downstream side, and it is connected to the bladder outlet at the valve's upstream side, and is connected to the trigger for opening and closing thereof, and is connected to a projectile launch port at the valve's downstream side for launching a projectile upon deflation of at least a portion of the bladder when it has been inflated. The launch port is located in the barrel of the main housing and connected to the downstream side of the bladder deflation valve, and is functionally connected to a launch tube adapted for receiving and shooting a projectile. The launch tube is one of a plurality of launch tubes which are located on a rotating magazine. The magazine advances after each shot to position the next launch tube with projectile for firing. In preferred embodiments, the bladder has a predetermined expansion size to which it is capable of being inflated, and an enclosure is provided around the bladder, which is a size less than the predetermined expansion size to enhance a controlled pressurization of the bladder during inflation and deflation.

BRIEF DESCRIPTION OF THE DRAWINGS

The present invention is more fully understood when the present specification is taken in conjunction with the drawings appended hereto, wherein.

DETAILED DESCRIPTION OF THE PRESENT INVENTION

The present invention toy air gun has been developed to provide high powered, safe shooting of projectiles, such as foam darts, while being fully self-contained, i.e. without the need for pressurized gas canisters. The toy air gun of the present invention is also capable of relatively constant releases of pressurized air to exhibit repeated, consistent firings. It relies upon manual pumping to inflate a bladder which will store pressurized air for subsequent firing and has an automatically advancing magazine for sequential multiple shots.

Figure 1:
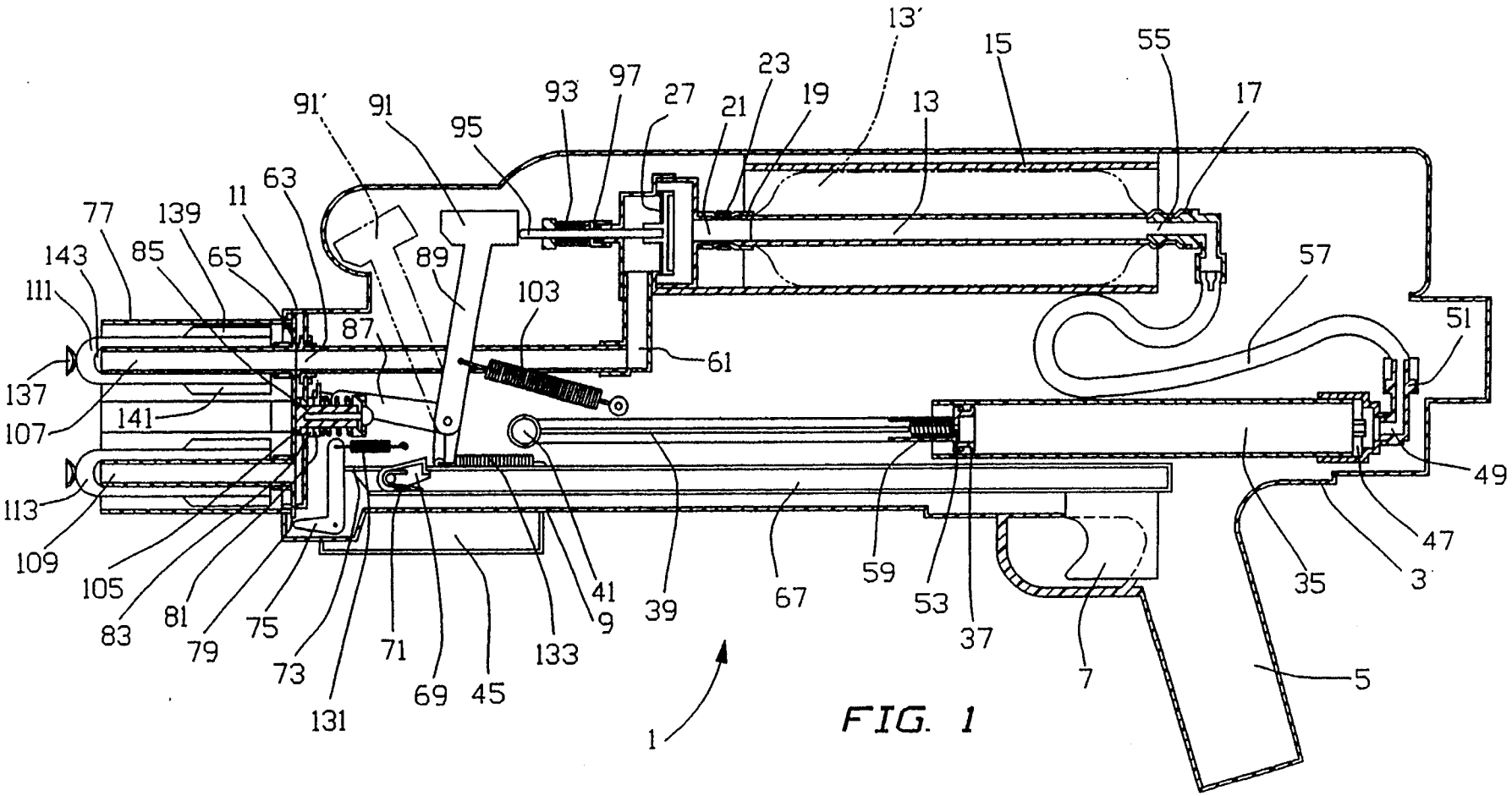
FIG. 1 shows a side cut view of a present invention toy air gun.
Figure 2:
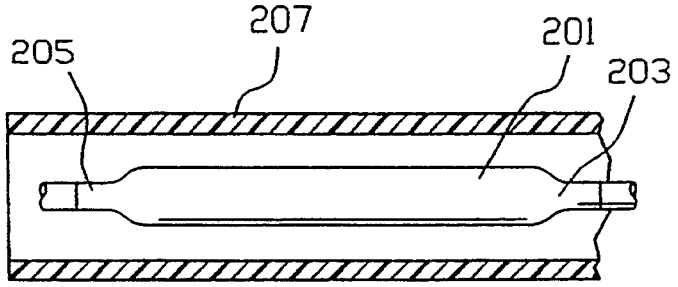
FIGS. 2 through 5 show a partial side view of an enclosure and bladder for a present invention toy air gun wherein the bladder is shown in various inflation/-deflation stages.

Referring now to FIG. 1, the operation of the present invention embodiment can best be explained. FIG. 1 is a side view of the present invention embodiment toy air gun 1 with main housing 3, handle 5, trigger 7 and barrel 9 with opening 11.

Bladder 13 is located within enclosure 15. Bladder 13 has inlet 17 and outlet 19 and is cylindrical, but could be of another shape and not exceed the scope of the present invention. Outlet 19 has outlet tube 21 connected thereto via ring 23. This outlet tube 21 is connected to bladder deflation valve 27, discussed below.

Toy air gun 1 is operated by pressurizing the bladder 13 with air. (Inflated bladder 13' illustrates the bladder after pressurization.) Air is forced into the bladder 13 by the relative movement of the piston 37 within the air pump shaft 35. The piston 37 is operated by the pump rod 39 that connects the piston 37 to the slider handle 45. The pump rod 39 is anchored to the slider handle 45 via formed connector 41. The slider handle 45 is operated manually by the user. The user holds the slider handle 45 with one hand and the gun handle 5 with the other. The slider handle 45 is then moved back and forth along the length of the barrel 9. The back and forth action is transferred to the piston 37, which forces air past a one way flow valve 47, through a length of air flow tubing 49, through a connector 51, tubing 57 and into the bladder 13. Air is continuously added to the bladder 13 via inlet 55 until a desired pressure is reached.

Once under pressure, the air in bladder 13 is prevented from flowing freely through the outlet tubing 21 by valve 27.

Safety release valve 53, with spring 59, prevents over pressurization. The strength of spring 59 in its biased configuration is calibrated, so that when the pressure of air within the gun reaches a predetermined maximum valve, the spring 59 will allow the valve 53 to be released until safe pressure is maintained.

Projectile 111, in this case a soft foam dart with fins, has a suction cup 137, fins 139 and 141, and hollow area 143 adapted to fit over launch tube 107. Projectile 113 is the same as soft dart projectile 111. Note that tube 107 has an outlet 63 at its forward end for launching. Launch tube 107 is a formed part of rotating magazine 77, which is mounted on barrel 11. This magazine 77 has shot capability and has, in this case, six launch tubes exemplified by tubes 107 and 109. Magazine 77 and toy gun 1 generally, operates as follows:

After a user has loaded projectiles onto the magazine 77 and has pressurized bladder 13, trigger 7 is actuated. As trigger 7 moves to the right (i.e., is pulled), trigger bar 67 likewise moves accordingly and trigger catch 69, with spring 71 keeping it upward, moves advance bell crank 87 downwardly counterclockwise and similarly moves hammer arm 89 and hammer 91. When trigger catch 69 moves to the right a predetermined distance, hammer arm 89 is snapped back by spring 103. This causes hammer 91 to strike rod 95 to overcome spring 93 against seal 97 and causes deflation valve 27 to open and close with a burst of air pressure which travels down tube 61 to launch port 63 (with rubber gasket seal 65) and down launch tube 107 to fire projectile 111.

Referencing again the same initial mechanism, i.e. the pull of trigger 7, when trigger bar 67 moves to the right, push plate 73 of bar 67 releases revolver lock 75, pulled by spring 131 so as to catch on magazine lock detent 79 (See also FIG. 6), locking the next position of rotating magazine 79 moved along by advance bell crank 87 discussed above. Thus, the gun 1 is operated by trigger 7 so as to advance the next launch tube on the rotating magazine, lock it in and fire it. In one preferred embodiment, the revolver lock 75 moves in position to catch lock detent 79, and the movement of the trigger bar 67 also causes the movement of advance spring 133 pulling on bell crank 87 which pushes down on six position ratchet 81, which mates with ratchet washer 83 which rotates magazine 77 by way of hex shaped boss 85. As magazine 77 rotates, six position circular ramp 105 causes magazine 77 to move forward away from rubber gasket seal 65 enough to allow rotation without considerable friction. As trigger bar 67 continues its motion to the right, trigger catch 69 moves hammer arm 89 to the right, cocking it until it is released. When the hammer hits rod 95, valve 27 rapidly opens and closes to fire a projectile, as already discussed. This is repeated five more times to achieve six sequential firings without reloading or repumping.

FIGS. 2 through 5 show side, partially cut, simplified views of a present invention toy air gun bladder 201 in various states of pressure. There is a preferred embodiment arrangement, as the bladder has a predetermined inflated size and enclosure 207 has a size less than that predetermined inflated size.

Figure 3:
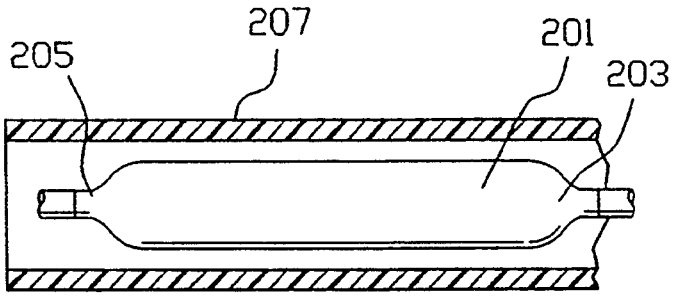
Figure 4:
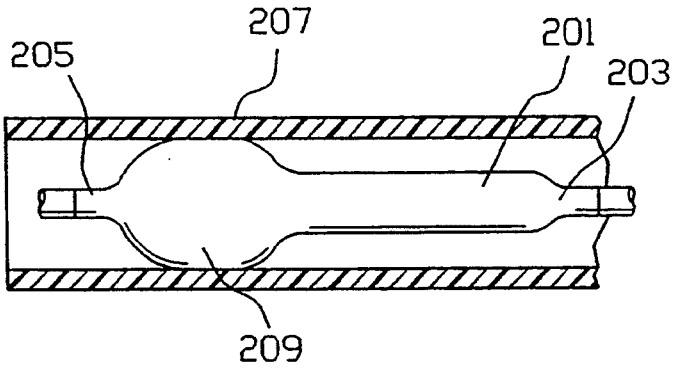
Figure 5:
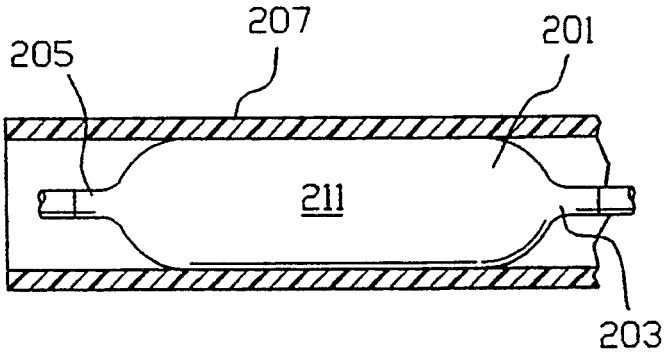

For example, bladder 201 with inlet end 203 and outlet end 205 may be cylindrical and of a specific length. Its uninflated diameter may be one inch and fully inflated with 25 psig, it may have a four inch diameter and thus a size or volume accordingly to its length. Enclosure 207 will have a diameter of, for example, three and one half inches. This causes inflation and deflation to occur with a significant part of the inflation or deflation at a fixed pressure. Thus, in FIG. 2, bladder 201 is at 0 psig. In FIG. 3, there is a pressure needed to cause initial expansion, here 20 psig. Once initial expansion, i.e., actual inflation, has begun as in FIG. 4, the pressure will be lower, i.e. 15 psig. (This is much like blowing up a balloon, where initially greater force is needed to start to stretch the balloon and then inflation takes less pressure.) As more air is added, the bladder 201 will expand down the enclosure at the fixed pressure of 15 psig, as shown in FIG. 5. Likewise, deflation will occur in reverse but at the constant pressure of 15 psig.

It should now be recognized that preferred embodiments toy air guns of the present invention having the enclosure about the bladder, will allow for repeat shots with the same burst of air and thus consistency in firing, until the bladder is substantially fully deflated.

Figure 6:
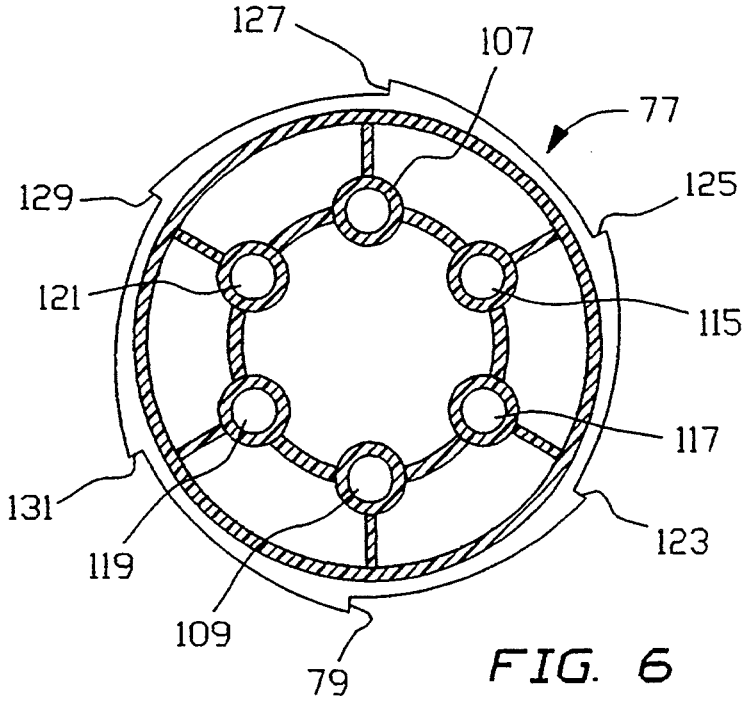
FIG. 6 shows a front, cut view of a multi-shot magazine used in a present invention toy air gun; and, FIG. 7 shows a front view of the hammer and advance bell crank used in the present invention toy air gun shown in FIG. 1.

FIG. 6 shows a front, cut view of reloading magazine 77 shown in FIG. 1, with identical parts identically numbered. This is merely to show the arrangement of the six launch tubes shown as tubes 107, 115, 117, 109, 119 and 121, as well as detents 79, 123, 125, 127, 129 and 131.

Figure 7:
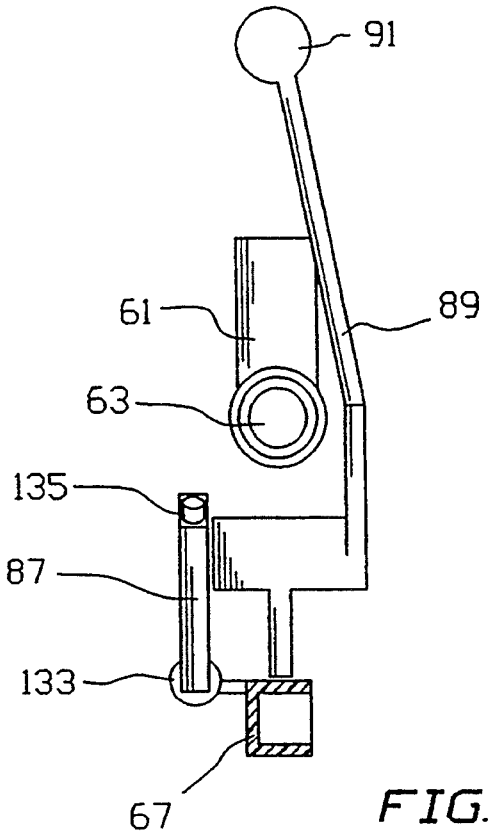

FIG. 7 shows a front view of the hammer mechanism and advance bell crank mechanism shown in FIG. 1 side view, with identical parts identically numbered.

Obviously, numerous modifications and variations of the present invention are possible in light of the above teachings. It is therefore understood that within the scope of the appended claims, the invention may be practiced otherwise than as specifically described herein.

What is claimed is:

1. A projectile-shooting toy air gun which comprises:

(a) a main housing having a barrel adapted for receiving a projectile, a handle and a trigger located thereon;

(b) a high pressure, inflatable bladder connected to said main housing, said bladder having an inlet and an outlet;

(c) a pressurizing means for providing air pressure to said bladder to inflate same, said pressurizing means being physically connected to said housing and being functionally connected to said bladder inlet;

(d) a bladder deflation valve having an upstream side and a downstream side, and being connected to said bladder outlet at said valve's upstream side, and being connected to said trigger for opening and closing thereof, and being connected to a projectile launch port at said valve's downstream side for launching a projectile upon deflation of at least a portion of said bladder when it has been inflated, said valve having a first, closed position to maintain bladder inflation and a second, open position to effect bladder deflation;

(e) a launch port located in the barrel of said main housing and connected to the downstream side of said bladder deflation valve, and adapted for connection to a launch tube for shooting a projectile;

(f) a multi-shot projectile magazine attached to said barrel and having a plurality of launch tubes thereon, each adapted for receiving and shooting a projectile, said magazine having one launch tube aligned with said launch port and being advanceable to provide sequential firings of a plurality of projectiles; and, (g) said bladder having a predetermined expansion size to which it is capable of being inflated, and an enclosure is provided around said bladder, said enclosure being of a size less than said predetermined expansion size to enhance a controlled pressurization of said bladder during inflation and deflation.

2. The toy air gun of claim 1 wherein said bladder deflation valve is generally in its first, closed position and is moved to its second, open position by trigger activation.

3. The toy air gun of claim 2 wherein said bladder deflation valve is connected to a spring and is spring biased to its first, closed position, and a snap-action release occurs when said trigger is activated and overcomes said spring.

4. The toy air gun of claim 1 wherein said pressurizing means is an air pump with a slider.

5. The toy air gun of claim 4 wherein said air pump is attached to said main housing below said barrel.

6. The toy air gun of claim 4 wherein said air pump has a first one way valve which permits pressurization towards said bladder and prevents pressurized air from escaping from said pump away from said bladder.

7. The toy air gun of claim 6 wherein said air pump has a second valve which is a pressure release valve which releases pressure from pumping said pump above a predetermined pressure level.

8. The toy air gun of claim 1 wherein said trigger is connected to said magazine so as to advance said magazine from one launch tube to an adjacent launch tube upon activation of said trigger.

9. The toy air gun of claim 8 wherein said magazine is cylindrical.

10. The toy air gun of claim 1 further including a projectile having an elongated body adapted to be inserted into said barrel and having an elongated hollow center adapted to fit over said launch tube.

11. The toy air gun of claim 10 wherein said projectile is a soft dart.

* * * * *